US012709842B2

(12) United States Patent
Miettinen et al.

(10) Patent No.: US 12,709,842 B2
(45) Date of Patent: Aug. 18, 2026

(54) PNEUMATIC ZONE-CONTROLLED DEFLECTION COMPENSATION FOR ROLL

(71) Applicant: Aalto University Foundation sr, Aalto (FI)

(72) Inventors: Mikael Miettinen, Aalto (FI); Raine Viitala, Aalto (FI); Petri Kuosmanen, Aalto (FI)

(73) Assignee: Aalto University Foundation sr, Aalto (FI)

( * ) Notice: Subject to any disclaimer, the term of this patent is extended or adjusted under 35 U.S.C. 154(b) by 0 days.

(21) Appl. No.: 18/273,538

(22) PCT Filed: Jan. 24, 2022

(86) PCT No.: PCT/FI2022/050046
§ 371 (c)(1),
(2) Date: Jul. 20, 2023

(87) PCT Pub. No.: WO2022/157424
PCT Pub. Date: Jul. 28, 2022

(65) Prior Publication Data

US 2024/0150964 A1 May 9, 2024

(30) Foreign Application Priority Data

Jan. 22, 2021 (FI) ..... 20210005

(51) Int. Cl.
*D21G 1/02* (2006.01)

(52) U.S. Cl.
CPC ..... *D21G 1/022* (2013.01)

(58) Field of Classification Search
CPC ..... D21G 1/022
See application file for complete search history.

(56) References Cited

U.S. PATENT DOCUMENTS

| | | | | |
|---|---|---|---|---|
| 4,506,421 A | | 3/1985 | Appenzeller et al. | |
| 5,075,298 A | * | 12/1991 | Aszodi | C07D 519/00 514/206 |
| 10,598,222 B2 | | 3/2020 | Devitt et al. | |

FOREIGN PATENT DOCUMENTS

| | | |
|---|---|---|
| AT | 511 527 A2 | 12/2012 |
| DE | 40 23 235 A1 | 1/1992 |
| FI | 123057 B | 10/2012 |

OTHER PUBLICATIONS

International Search Report and Written Opinion mailed on Apr. 29, 2022 in PCT International Application No. PCT/FI2022/050046.

* cited by examiner

*Primary Examiner* — Abbas Rashid
*Assistant Examiner* — Elisa H Vera
(74) *Attorney, Agent, or Firm* — Wan Chieh Lee; Haug Partners LLP

(57) ABSTRACT

A deflection compensated roll, comprising a shaft, a shell configured to rotate around the shaft, one or more loading units between the shaft and the shell configured to adjust a nip load profile. The loading unit comprising a pressure chamber, a seal configured to seal the pressure chamber with pressurized gas, and a flexible mounting configured to mount the seal 4 flexibly on the shaft. Also, a method for controlling a nip load with a deflection compensated roll is disclosed.

13 Claims, 4 Drawing Sheets

PNEUMATIC ZONE-CONTROLLED DEFLECTION COMPENSATION FOR ROLL

PRIORITY CLAIM

This application is the National Stage entry under 35 U.S.C. § 371 of International Application No. PCT/FI2022/050046, filed on Jan. 24, 2022, published on Jul. 28, 2022 under Publication Number WO 2022/157424 A1, which claims the benefit of priority under 35 U.S.C. § 119 of Finnish Patent Application Number FI 20210005 filed on Jan. 22, 2021, the entireties of which are herein incorporated by reference.

FIELD OF THE INVENTION

The field of the present invention relates to paper and cardboard machines, their rolls and especially compensation of rolls' deflections.

BACKGROUND OF THE INVENTION

Deflection compensated rolls are used in paper and cardboard mills to even the pressure distribution in a nip. Uneven nipload leads to thickness and quality variations in manufactured product.

Current methods use hydraulic systems for compensation that are inefficient due to viscous losses. Inefficiency means high operating costs, for example a press section of a paper machine can require 1.8 MW of cooling power.

The deflection compensated rolls require loading units that can withstand line loads from, for example, 80 kN/m to 150 kN/m. In addition, the roll surface velocity is typically 80 km/h to 120 km/h during operation depending on the type of the machine. Currently, the loading units are oil-lubricated utilizing either gliding shoes or pressure chambers acting on an internal surface of the roll shell. Energy consumption of the current systems ranges from hundreds of kilowatts to megawatts. Pneumatic deflection compensation with air-lubricated seals would have lower friction due to the smaller viscosity of air. Additionally, less power is required to cool the roll due to the lower heating from the lower friction. Therefore, a pneumatic deflection compensation system utilizing aerostatic bearings in the loading units can result in significant energy savings.

However, current aerostatic bearing technology requires narrow and tight manufacturing tolerances and does not allow for misalignment between the bearing and its opposing surface. Required tolerances have limited the application of aerostatic bearings to precision motion and positioning applications. In these applications, air bearings are used to replace conventional sliding or rolling element bearings.

Even though paper machine rolls are manufactured with high precision, achieving the required tolerances for direct application of current aerostatic bearing technology is not feasible due to flexibility of the rolls. Therefore, robust and compliant aerostatic bearings suitable for large flexible rotor systems are required for the implementation of pneumatic deflection compensated rolls.

One present solution describing prior art for pneumatic compensation of a roll has been disclosed in Finnish patent FI 123057 B. In the document there is the floating roller having a shaft that is rotatably supported on shell. A pressure chamber is delimited between the shaft and shell by a sealing arrangement. The sealing gap is provided in the seal structure of sealing arrangement so that the lubricant gas mixture flows between the seal structure and the inner surface of shell. The solution disclosed in the said patent has the disadvantage that it consists of only one pressure chamber which does not enable proper and precise pneumatic control of the gap between the shaft and shell.

Another solution describing prior art for use of air bearing as sealing solution has been disclosed in U.S. Pat. No. 10,598,222 B2. This solution is intended to seal a turbine axle. However, it is rigid and does not enable a flexible structure and tolerate position errors which this invention does as well as using of more rough tolerances.

The objective of the disclosed invention to eliminate and overcome the disadvantages in the present solutions and to disclose a new pneumatic, zone-controlled deflection compensation system for a roll which benefits are presented in this patent document.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. The scope of protection sought for various embodiments of the present disclosure is set out by the independent claims.

An example embodiment discloses a new pneumatic, zone-controlled deflection compensation system for a roll.

An example embodiment use aerostatic bearings as seals for a pressure chamber used as a loading unit for a deflection compensated roll. The proposed seals are flexibly mounted to the frame of the loading unit to allow greater misalignment and larger tolerances for the system.

The pneumatic system utilizing air bearings as seals would increase energy efficiency of compensation systems. The air bearings are used as seals to divide high pressure areas from low pressure areas inside the roll body to control the nipload. Using air as the working fluid leads to minimal losses—air has low viscosity so energy consumption could be dramatically reduced compared to existing technology.

One solution of deflection compensation roll is pneumatic with non-contact seals, which is energy efficient solution and requires minimal maintenance.

According to a first aspect, a deflection compensated roll, may comprise a shaft; a shell configured to rotate around the shaft; one or more loading units between the shaft and the shell configured to adjust a nip load profile, wherein the loading unit may comprise a pressure chamber; a seal configured to seal the pressure chamber with pressurized gas; and a flexible mounting configured to mount the seal flexibly on the shaft.

According to an example embodiment of the first aspect, the seal may comprise a body; a restrictor; and means for distributing pressurized gas to the restrictor.

According to an example embodiment of the first aspect, the deflection compensated roll may comprise the seal gap between the seal and the shell, and wherein the seal may be configured to flow the pressurized gas through the restrictor into the seal gap.

According to an example embodiment of the first aspect, the seal may have a first and a second mode, wherein the seal may be configured in the first mode to allow the pressurized gas from the seal to flow into the pressure chamber and/or the ambient, when the seal gap may have higher pressure than the pressure chamber; and in the second mode to allow gas from the pressure chamber leak through the seal gap to the ambient and/or to allow gas from the seal flow to the ambient, when the seal gap may have lower pressure than the pressure chamber.

According to an example embodiment of the first aspect, the means for distributing pressurized gas may comprise at least one distribution groove, channel, or hole in the body or in the restrictor.

According to an example embodiment of the first aspect, each of the at least one distribution groove, channel, or hole may be configured to be connected to own pressure supply; or at least two distribution grooves (9), channels, or holes may be configured to be connected to common pressure supply.

According to an example embodiment of the first aspect, the restrictor may be a porous material element.

According to an example embodiment of the first aspect, the flexible mounting may comprise at least one guide element and loading part.

According to an example embodiment of the first aspect, the guide element and the loading part may be in one element.

According to an example embodiment of the first aspect, the at least one guide element may comprise at least one of the following: a flexure, a flexing element, compliant mechanism, slide, or aerostatic bearing guide.

According to an example embodiment of the first aspect, the at least one aerostatic bearing guide may be configured to allow the seal to float and be preloaded against the shell by the loading part.

According to an example embodiment of the first aspect, the at least one loading part may comprise at least one of the following: an actuator, a pressurized hose, pressurized bladder, and/or a spring.

According to an example embodiment of the first aspect, the deflection compensated roll may be configured to compensate deflection by adjusting supply and/or discharge of the pressurized gas to and/or from at least one of the following: the seal, the pressure chamber, and/or the flexible mounting.

According to an example embodiment of the first aspect, the deflection compensated roll may comprise the loading units configured to share a common seal dividing multiple pressure chambers; the multiple loading units configured to have individual seals dividing the pressure chambers; the single loading unit; or combination of the single large loading unit and the multiple smaller loading units.

According to a second aspect, a method for controlling a nip load with a deflection compensated roll, wherein the deflection compensated roll may comprise a shaft; a shell configured to rotate around the shaft; one or more loading units between the shaft and the shell, wherein the loading unit may comprise a pressure chamber, a seal, and a flexible mounting, wherein the method may comprise: adjusting a nip load profile by the one or more loading units by sealing the pressure chamber with pressurized gas by the seal; and mounting the seal flexibly on the shaft.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

Reference will now be made in detail to example embodiments, examples of which are illustrated in the accompanying drawings. The detailed description provided below in connection with the appended drawings is intended as a description of the present examples and is not intended to represent the only forms in which the present example may be constructed or utilized. The description sets forth the functions of the example and the sequence of steps or operations for constructing and operating the example. However, the same or equivalent functions and sequences may be accomplished by different examples.

An example embodiment comprises a method and device to control nip force or load pneumatically. It comprises of a seal system dividing chambers or zones inside a paper machine roll and allows individual pressurization of the zones.

An example embodiment is a new type of a deflection compensated roll that uses pressurized gas as the working media in the pressure chamber and the seals. The seal system utilizing porous aerostatic seals and flexible mounting to solve the problems of previous designs.

An example embodiment is a type of loading unit for the deflection compensated rolls. The deflection compensated roll refers to a roll that has a mechanism to adjust the nip load profile. The deflection compensating roll consists of a non-rotating shaft and a rotating shell. There can be several loading units inside the roll to allow local adjustment of the nip load profile.

An example embodiment arranges multiple loading units to span the length of the roll. Each loading unit consists of a pressure chamber between the shaft and the shell of the roll, that is sealed with air-lubricated seals. The seals are supported with flexing elements and are preloaded against the mating surface. The flexibly mounting tolerates runout of the shell and keeps the seal gap height sufficient for operation of the seal.

Working fluids in the seals and pressure chambers are gas, for example, air or nitrogen. The seal consists of a body and a porous material and has means of distributing the pressurized gas to the porous material. The gas can be distributed with channels, grooves or holes in the body or the porous material. The pressurized air flows through the porous material to the seal gap. Commonly, the seal gap is 1 to 25 micrometers high, preferably it is 1 to 5 micrometers high. The supply air forms a high-pressure region in the seal gap, keeping it from contacting the mating surface.

The air lubricated seals have two possible operating modes. The first mode has higher pressure in the seal gap than in the pressure chamber, therefore the seal gas flows into the chamber. The other mode has lower pressure in the seal gap than in the chamber, therefore the gas leaks from the chamber, trough the seal gap into the ambient. However, the narrow seal gap throttles the flow. Both operating modes are usable with the proposed loading units.

Figure 1:
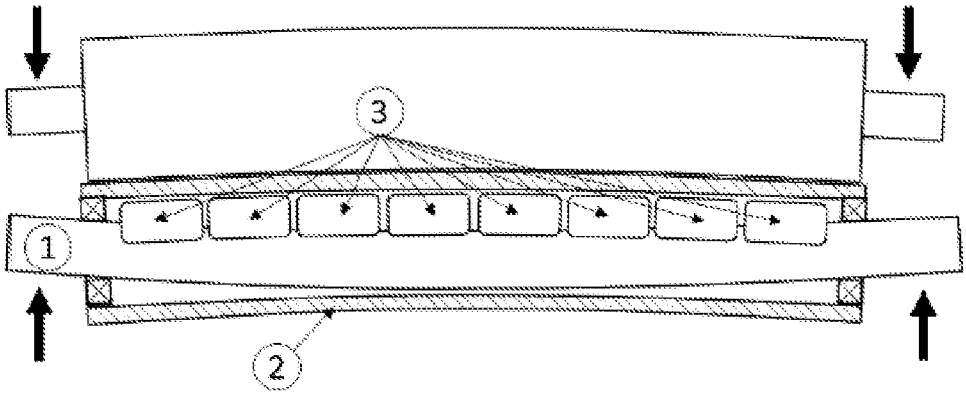
FIG. 1 presents an arrangement of loading units in a nip with a deflection compensated roll.

FIG. 1 presents an arrangement of loading units 3 in a nip with a deflection compensated roll. The loading units 3 are attached to the stationary shaft 1 and act on the rotating shell 2. The loading units 3 counteract the external load 13 from the nip contact and correct for an even line load distribution.

Figure 2:
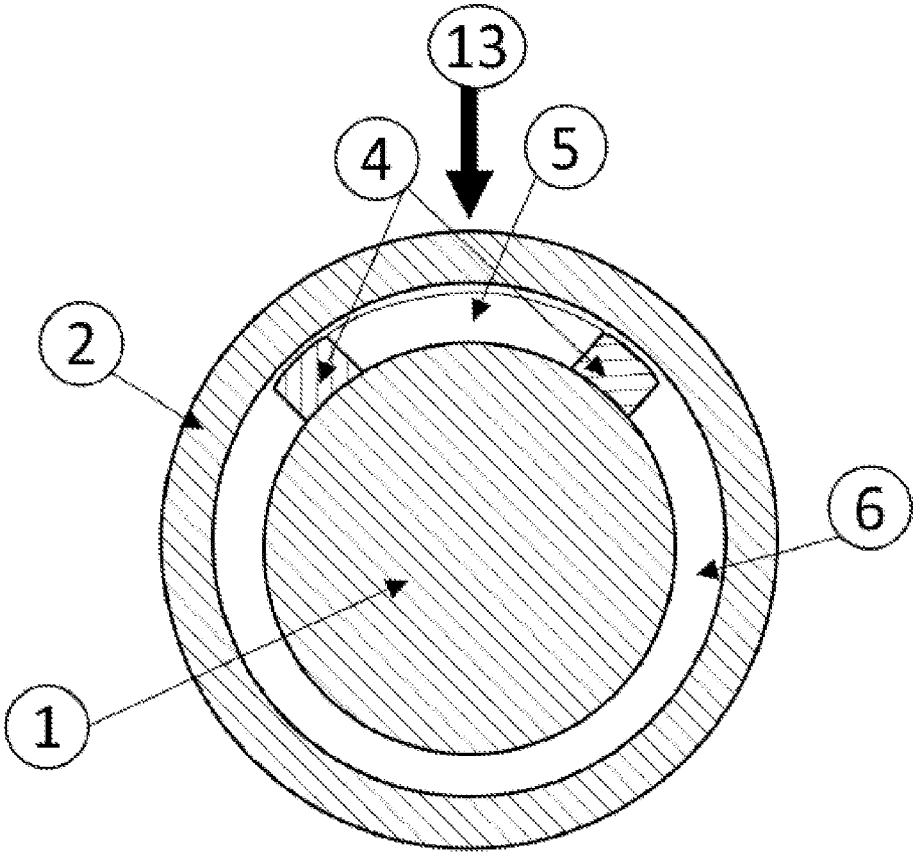
FIG. 2 presents a cross section view of a roll with the pneumatic deflection compensated roll.

FIG. 2 presents cross section view a of roll with pneumatic deflection compensated roll. The rotating shell 2 is around a stationary shaft 1. Loading units 3 between the shaft 1 and shell 2 act to counteract the effect of the external load 13. The external load 13 may originate from a paper or cardboard web, a belt or from contact with another roll or from a mass of the shell 2. The load can act on the shell 2 as a line load or a load spread to any arc length on the shell 2. The loading units 3 consist of pressure chamber 5, that is sealed from the ambient pressure 6. The pressure chambers 5 are divided by air lubricated seals 4. Pressure chambers 5 can span any arc length of the roll. The deflection of the shell 2 may be compensated by the force originating from the pressure difference of the pressure in the loading unit 3 and in the ambient 6 inside the roll. The absolute pressure in the ambient 6 may be lower or higher than the normal atmospheric pressure, affecting the pressure difference. Lower absolute pressure may increase the pressure difference and thus may increase the load capacity. Higher absolute pressure may lower the pressure difference between the loading unit 3 and the ambient 6, that may direct gas flow out of the roll at cost of decreased load capacity. Benefits of the gas flow out of the roll may include blowing dirt away from the narrow gaps of the seals 4 inside the roll.

FIGS. 3*a* to 3*d* presents possible arrangements for the loading units 3, viewed from top-down orientation, showing the seals 4 and the pressure chambers 5.

Figure 3:
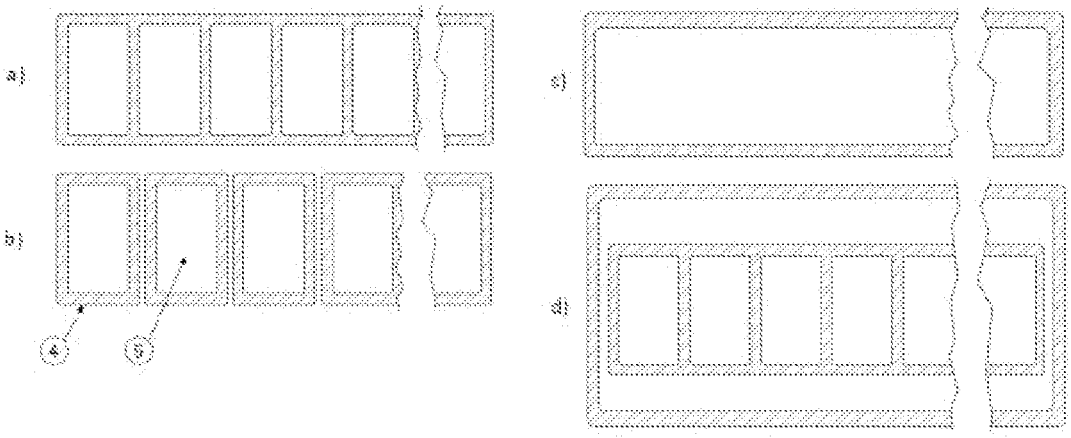
FIGS. 3*a* to 3*d* presents possible arrangements for the loading units, viewed from top-down orientation.

FIG. 3*a* has loading units that share a common seal dividing multiple pressure chambers.

FIG. 3*b* has multiple loading units that have individual seals dividing the pressure chambers.

FIG. 3*c* has a single loading unit.

FIG. 3*d* is combination of a single large loading unit 3 and multiple smaller ones. The large loading unit 3 has large area to counteract most of the load, and the multiple loading units 3 are used for local corrections.

Figure 4A:
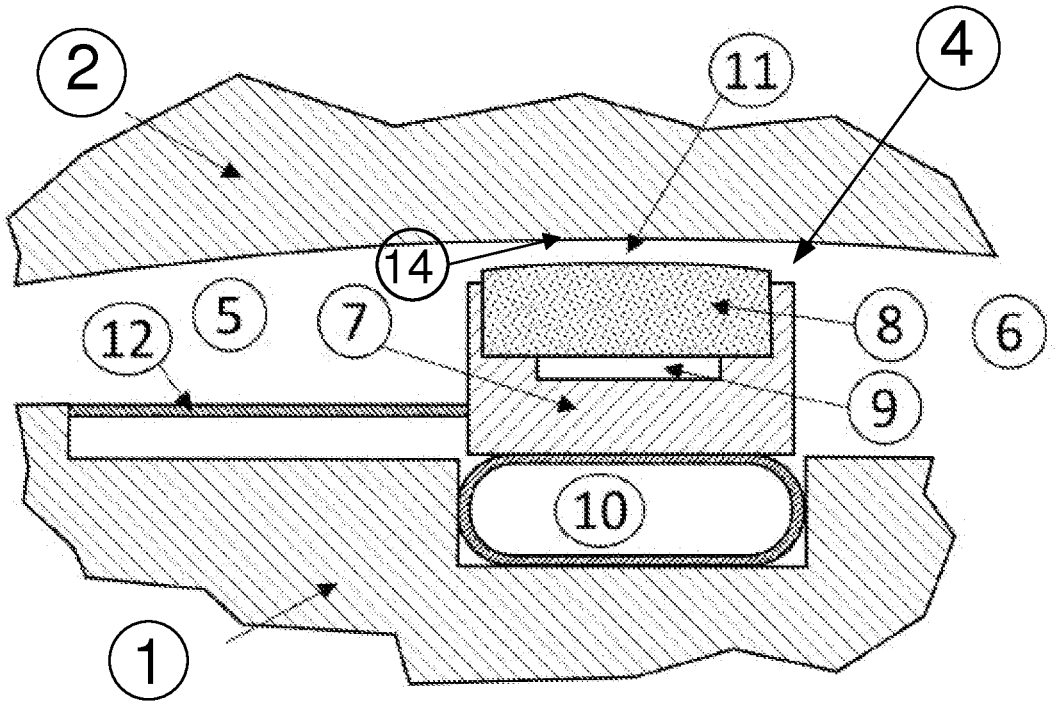
FIGS. 4*a* to 4*c* present a possible cross section structures of a seal.

FIG. 4*a* presents a possible cross section structure of the seal 4. The seal 4 is mounted on the shaft 1 with a flexing element 12. The seal 4 is preloaded against the shell 2. The preload is generated with a pressurized bladder which in some applications can be a hose or in some other applications an actuator 10. The seal 4 has a porous material element 8 that is fed pressurized gas through the distributing groove 9 that is between the porous element 8 and the seal body 7. The seal gas flows through the porous material into the seal gap 11, forming high pressure region in the narrow gap between the seal 4 and the shell surface. The seal 4 divides the pressure chambers 5 from the ambient 6.

According to an example embodiment, a deflection compensated roll comprising a shaft 1, a shell 2 configured to rotate around the shaft 1, and one or more loading units 3 between the shaft 1 and the shell 2 configured to adjust a nip load profile. The loading unit 3 may comprise a pressure chamber 5, a seal 4 configured to seal the pressure chamber 5 with pressurized gas, and a flexible mounting configured to mount the seal 4 flexibly on the shaft 1. The nip load profile may also be adjusted by sealing the pressure chamber 5 with pressurized gas by and/or controlling the pressure level in the pressure chamber 5.

According to an example embodiment, the seal comprising a body 7, a restrictor, and means for distributing pressurized gas to the restrictor. The body 7 may support the restrictor and may form channels and attachments for the means for distributing pressurized gas. The material of the body 4 is for example, aluminium, plastic, or composite, such as carbon fibre composite. The body 4 may be light and/or flexible to be able to follow the mating surface 14 as well as possible. According to the example embodiment, the restrictor may be a porous material element 8 made of porous material for example, graphite. The porous material 8 may throttle the pressurized gas and transmit it into the seal gap 11 distributed over the entire surface of the seal 4.

According to the example embodiment, the means for distributing pressurized gas comprising at least one distribution groove 9, channel, or hole in the body 7 or in the restrictor. According to the example embodiment each of the at least one distribution groove 9, channel, or hole is configured to be connected to own pressure supply, or at least two distribution grooves 9, channels, or holes are configured to be connected to common pressure supply. This means that there may be one or more distributing means distributing pressurized gas. One pressure supply may support one or more distributing means or each distributing means have own pressure supply.

According to the example embodiment, deflection compensated roll comprising the seal gap 11 between the seal 4 and the shell 2. The seal 4 may be configured to flow the pressurized gas through the restrictor into the seal gap 11.

According to the example embodiment, the seal 4 has a first and a second mode. The seal 4 may be configured in the first mode to allow the pressurized gas from the seal 4 to flow into the pressure chamber 5 and/or the ambient 6, when the seal gap 11 may have higher pressure than the pressure chamber 15. The seal 4 may be configured in the second mode to allow gas from the pressure chamber 5 leak through the seal gap 11 to the ambient 6 and/or to allow gas from the seal 4 flow to the ambient 6, when the seal gap 11 has lower pressure than the pressure chamber 5.

According to an example embodiment, pressure in the ambient 6 may be higher or lower than the normal atmosphere pressure. The ambient pressure 6 may be limited at the ends of the roll by seals to form a chamber. A pressure smaller than the atmospheric pressure may be used to increase the load capacity. A higher than atmospheric pressure i.e. overpressure may lead the gas flow out of the roll, which may help to keep it clean.

According to the example embodiment, the flexible mounting comprising at least one guide element and loading part. According to the example embodiment, the guide element and the loading part are in one element. This means that functionalities of the guide element and the loading part may be combined in one element.

According to the example embodiment, the at least one guide element comprising at least one of the following: a flexure, a flexing element (12), a compliant mechanism, slide, and/or an aerostatic bearing guide 15. The compliant mechanism may comprise for example, simple or 4-bar linkage comprising one or more adjacent flexures or compliant mechanisms.

According to the example embodiment, the at least one aerostatic bearing guide 15 may be configured to allow the seal 4 to float and be preloaded against the shell 2 by the loading part.

According to the example embodiment, the at least one loading part comprising at least one of the following: an actuator 10, a pressurized hose, a pressurized bladder, or a spring. The actuator 10 may comprise at least one of the following: a pneumatic tube, a bladder actuator, a pneumatic or hydraulic cylinder, an electromechanics actuator, and/or an aerostatically sealed pneumatic actuator.

According to the example embodiment, the deflection compensated roll is configured to compensate deflection by adjusting supply and/or discharge of the pressurized gas to and/or from at least one of the following: the seal 4, the pressure chamber 5 and/or the flexible mounting. The flexible mounting may be the loading part. Thus, the loading unit 3 may get pressurized gas at least through the seal 4 from which it flows the pressurized gas into the pressure chamber 5. In addition to that the pressurized gas may be fed straight to the pressure chamber 5. It may also be possible to discharge the pressurized gas straight from the chamber 5. Also, the pressurized gas may be fed to the loading part. The loading part may comprise the actuator 10.

According to the example embodiment, the deflection compensated roll comprising the loading units 3 configured to share a common seal 4 dividing multiple pressure 5 chambers; the multiple loading units 3 configured to have individual seals 4 dividing the pressure chambers 5; the single loading unit 3; or combination of the single large loading unit 3 and the multiple smaller loading units 3. The combination of the large and smaller loading units 3 may allow general or rough adjustment with large loading unit 3 and fine adjustment with the small loading units 3.

Figure 4B:
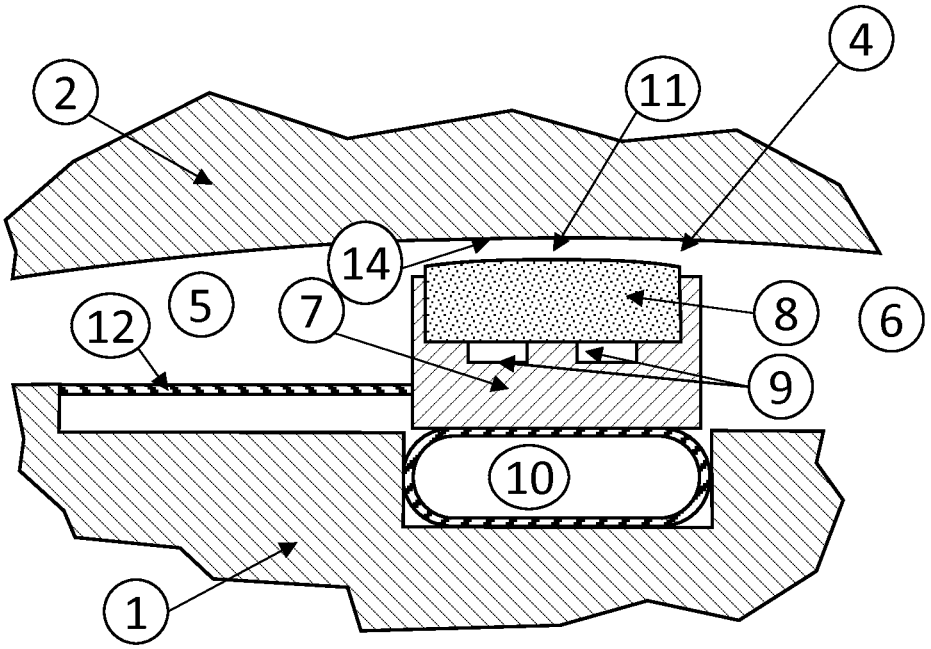

An example of FIG. 4*b* presents a possible cross section structure of a seal 4. It is similar to the cross section of the FIG. 4*a*, but it has different means for distributing pressurized gas to the restrictor. The means for distributing pressurized gas may comprise at least two distributing grooves 9. This means that it may be possible to bring differently pressurized gas to both of the distributing grooves 9. This may allow to adjust leaking of the gas from the pressure chamber 5 by means of the pressure difference.

Figure 4C:
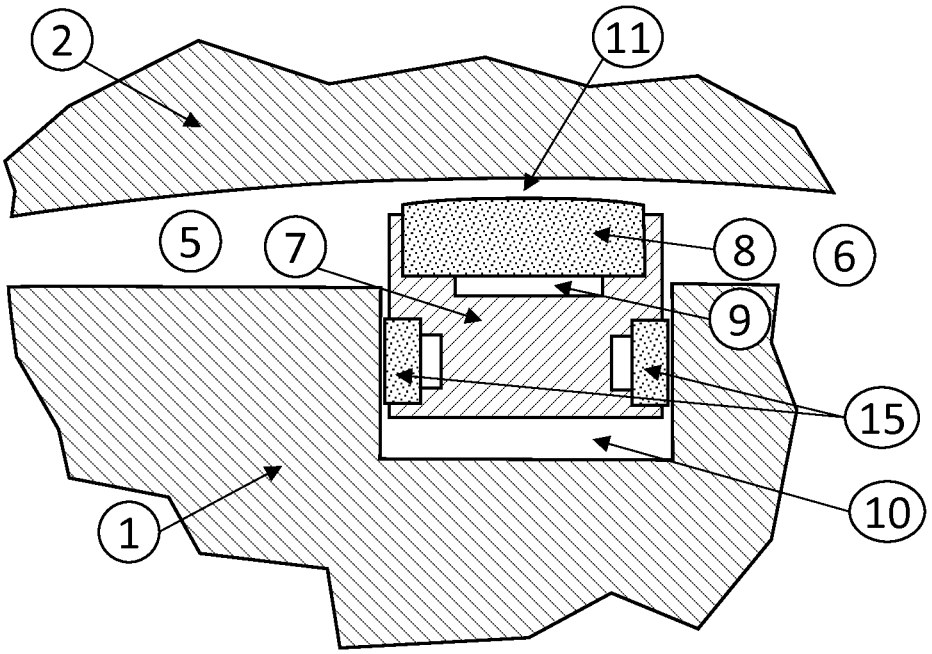

An example of FIG. 4*c* presents a possible cross section structure of a seal 4. It is similar to the cross section of the FIG. 4*a*, but the flexible mounting comprises two aerostatic bearing guides 15 instead of actuator 10 and flexing element 12. Thus, the guide element and the loading part may be in aerostatic bearing guides 15. The seal 4 may be supported with aerostatic bearing guides 15, which may allow the seal 4 to float and be preloaded against the shell 2 by the loading part. The loading part may be an actuator comprising a pressurized volume that may be sealed with the at least one aerostatic guide bearing 15. The amount of preload may be varied by adjusting the pressure in the volume of the actuator. The bearings of the aerostatic bearing guide 15 may be connected to individual pressure supplies or to the same pressure supply as the feed groove 9 of the seal 4.

According to the example embodiment, a 300 mm by 140 mm loading unit 3 has been tested in laboratory conditions. The load capacity of the tested loading unit 3 was 12 kN and the air consumption was 12.7 L/min at 1.1 mm runout of the opposing surface. Limiting factor on the performance is the air gap height between the seal 4 and the opposing mating surface 14. Contact generates friction and wear, and too large seal gap 11 allows leakage from the pressure chamber 5, which increases air consumption. Based on these results, the line load capacity of an aerostatic deflection compensated roll is in range of 86 to 171 kN/m. Per unit length of roll, the air consumption may range in the range of to 93 L/(min*m), resulting in total power consumption of 1 to 5 kW/m, consisting of friction and compressor powers. The tests show that the aerostatic seals 4 may be feasible for pneumatic deflection compensation devices.

Figure 5:
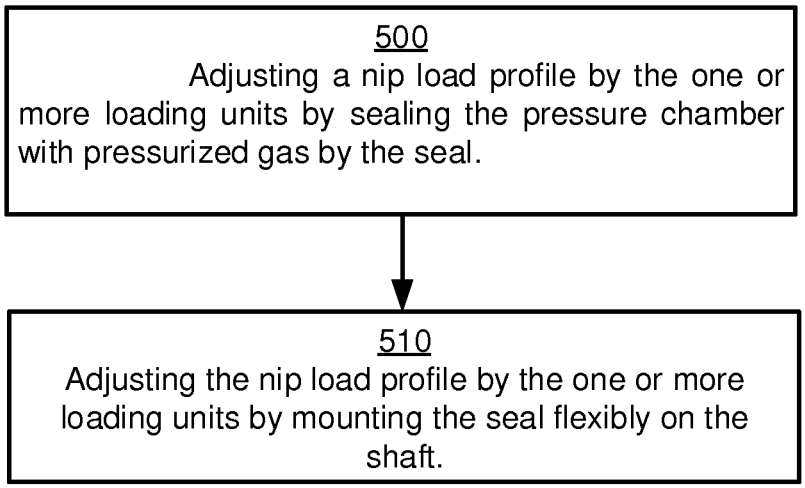
FIG. 5 illustrates an example of a method for controlling a nip load with a deflection compensated roll, according to an example embodiment.

FIG. 5 illustrates an example of a method for controlling a nip load with a deflection compensated roll, wherein the deflection compensated roll comprising a shaft 1, a shell 2 configured to rotate around the shaft, and one or more loading units 3 between the shaft 1 and the shell 2. The loading unit may comprise a pressure chamber 5, a seal 4, and a flexible mounting.

At operation 500, the method may comprise adjusting a nip load profile by the one or more loading units 3 by sealing the pressure chamber 5 with pressurized gas by the seal 5. The nip load profile may also be adjusted by sealing the pressure chamber 5 with pressurized gas by and/or controlling the pressure difference between the pressure chamber 5 and the ambient 6.

At operation 510, the method may comprise adjusting a nip load profile by the one or more loading units 3 by mounting the seal 4 flexibly on the shaft 1.

Further features of the method directly result for example from the functionalities and parameters of the deflection compensated roll as described in the appended claims and throughout the specification and are therefore not repeated here. Different variations of the methods may be also applied, as described in connection with the various example embodiments.

The deflection compensated roll may be configured to perform or cause performance of any aspect of the methods described herein.

Any range or value given herein may be extended or altered without losing the effect sought. Also, any embodiment may be combined with another embodiment unless explicitly disallowed.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item may refer to one or more of those items.

The steps or operations of the methods described herein may be carried out in any suitable order, or simultaneously where appropriate. Additionally, individual blocks may be deleted from any of the methods without departing from the scope of the subject matter described herein. Aspects of any of the embodiments described above may be combined with aspects of any of the other embodiments described to form further embodiments without losing the effect sought.

The term 'comprising' is used herein to mean including the method, blocks, or elements identified, but that such blocks or elements do not comprise an exclusive list and a method or apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from scope of this specification.

The invention claimed is:

1. A deflection compensated roll, comprising:
a shaft;
a shell configured to rotate around the shaft;
one or more loading units between the shaft and the shell configured to adjust a nip load profile, wherein the one or more loading units comprise
a pressure chamber;
a seal configured to seal the pressure chamber with pressurized gas; and
a flexible mounting configured to mount the seal flexibly on the shaft;
wherein the seal comprises, a body, a restrictor, and means for distributing pressurized gas to the restrictor;
the restrictor has a surface facing a seal gap, an entirety of the surface is spaced from a mating surface of the shell to define the seal gap between the restrictor and the mating surface; and
the restrictor is configured to flow the pressurized gas through the restrictor into the seal gap, wherein the pressurized gas is configured to keep the restrictor from contacting the mating surface.

2. The deflection compensated roll according to claim 1, wherein the seal has a first and a second mode, wherein the seal is configured
in the first mode to allow the pressurized gas from the seal to flow into the pressure chamber and/or an ambient, when the seal gap has higher pressure than the pressure chamber; and
in the second mode to allow gas from the pressure chamber to leak through the seal gap to the ambient and/or to allow gas from the seal flow to the ambient, when the seal gap has lower pressure than the pressure chamber.

3. The deflection compensated roll according to claim 1, wherein the means for distributing pressurized gas comprises at least one distribution groove, channel, or hole in the body or in the restrictor.

4. The deflection compensated roll according to claim 3, wherein
each of the at least one distribution groove, channel, or hole is configured to be connected to an own pressure supply; or
at least two distribution grooves, channels, or holes are configured to be connected to a common pressure supply.

5. The deflection compensated roll according to claim 1, wherein the restrictor is a porous material element.

6. The deflection compensated roll according to claim 1, wherein the flexible mounting comprises at least one of: a guide element and a loading part.

7. The deflection compensated roll according to claim 6, wherein the guide element and the loading part are in one element.

8. The deflection compensated roll according to claim 6, wherein the guide element comprises at least one of the following: a flexure, a flexing element, a compliant mechanism, a slide, and/or an aerostatic bearing guide.

9. The deflection compensated roll according to claim 8, wherein the aerostatic bearing guide is configured to allow the seal to float and be preloaded against the shell by the loading part.

10. The deflection compensated roll according to claim 6, wherein the loading part comprises at least one of the following: an actuator, a pressurized hose, a pressurized bladder, and/or a spring.

11. The deflection compensated roll according to claim 1, wherein the deflection compensated roll is configured to compensate deflection by adjusting supply and/or discharge of the pressurized gas to and/or from at least one of the following: the seal, the pressure chamber, and/or the flexible mounting.

12. The deflection compensated roll according to claim 1, wherein the one or more loading units comprise
multiple loading units configured to share a common seal dividing multiple pressure chambers;
multiple loading units each configured to have an individual seal dividing the multiple pressure chambers;
a single loading unit; or
a combination of a single large loading unit and multiple smaller loading units.

13. A method for controlling a nip load with a deflection compensated roll, wherein the deflection compensated roll comprises:
a shaft;
a shell configured to rotate around the shaft;
one or more loading units between the shaft and the shell, wherein the loading unit comprising a pressure chamber, a seal, and a flexible mounting, wherein the seal comprises, a body, a restrictor, and means for distributing pressurized gas to the restrictor, wherein the restrictor has a surface facing a seal gap, an entirety of the surface is spaced from a mating surface of the shell to define the seal gap between the restrictor and the mating surface, and wherein the restrictor is configured to flow the pressurized gas through the restrictor into the seal gap, wherein the method comprises:
adjusting a nip load profile by the one or more loading units by
sealing the pressure chamber with pressurized gas by the seal; and
mounting the seal flexibly on the shaft.

* * * * *